US009655425B2

(12) United States Patent
Sasaki et al.

(10) Patent No.: US 9,655,425 B2
(45) Date of Patent: May 23, 2017

(54) STRAP AND ELECTRONIC DEVICE

(71) Applicant: Panasonic Intellectual Property Management Co., Ltd., Osaka (JP)

(72) Inventors: Hirofumi Sasaki, Osaka (JP); Takeshi Mori, Osaka (JP); Yoshiaki Nagamura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/579,291

(22) Filed: Dec. 22, 2014

(65) Prior Publication Data

US 2015/0177791 A1 Jun. 25, 2015

(30) Foreign Application Priority Data

Dec. 25, 2013 (JP) ..... 2013-267401
Dec. 18, 2014 (JP) ..... 2014-256381

(51) Int. Cl.
*A45F 5/00* (2006.01)
*A45C 13/30* (2006.01)

(52) U.S. Cl.
CPC ..... *A45C 13/30* (2013.01); *A45C 2013/303* (2013.01); *A45F 2005/006* (2013.01); *A45F 2005/008* (2013.01); *A45F 2200/0525* (2013.01)

(58) Field of Classification Search
CPC . G06F 1/1656; A45C 13/30; A45C 2013/303; A45F 2005/006; A45F 2005/008; A45F 2200/0525
USPC ..... 224/267; 3/267
See application file for complete search history.

(56) References Cited

U.S. PATENT DOCUMENTS

| | | | | |
|---|---|---|---|---|
| 6,168,556 | B1 * | 1/2001 | Saavedra | 482/93 |
| 6,345,747 | B1 * | 2/2002 | Ogata | A45C 13/18 224/257 |
| 6,955,484 | B2 * | 10/2005 | Woodman | 396/423 |
| 7,320,318 | B1 * | 1/2008 | Tentler | F41B 5/1469 124/35.2 |
| 8,616,423 | B2 * | 12/2013 | Wizikowski | 224/218 |
| 8,783,533 | B1 * | 7/2014 | Marseille | 224/218 |
| 9,074,725 | B2 * | 7/2015 | Trotsky | |
| 2009/0120980 | A1 * | 5/2009 | Calayo | 224/257 |
| 2009/0227381 | A1 * | 9/2009 | Snavely, II | 463/47 |

(Continued)

FOREIGN PATENT DOCUMENTS

| | | |
|---|---|---|
| JP | 2008-216533 | 9/2008 |
| JP | 2009-53394 | 3/2009 |
| WO | 2009/101800 | 8/2009 |

*Primary Examiner* — Derek Battisti
(74) *Attorney, Agent, or Firm* — Wenderoth, Lind & Ponack, L.L.P.

(57) ABSTRACT

A strap is connected to an electronic device and used when the electronic device is held by a user with a user's hand. The strap comprises a loop portion formed of a band member in a loop-like shape, a connecting portion joined to the loop portion and connected to the electronic device, and a protecting member formed to cover a joining portion and a portion of a predetermined region in a bifurcation portion in the band member forming the loop portion, the joining portion being a portion where the connecting portion is connected to the band member and the bifurcation portion bifurcating and extending out from the joining portion, thereby protecting the user's hand.

9 Claims, 3 Drawing Sheets

(56) References Cited

U.S. PATENT DOCUMENTS

| | | | | |
|---|---|---|---|---|
| 2010/0118476 | A1* | 5/2010 | Li | 361/679.01 |
| 2010/0296235 | A1 | 11/2010 | Takemasa et al. | |
| 2011/0036879 | A1* | 2/2011 | Calayo | A45F 5/00 224/267 |
| 2012/0024917 | A1* | 2/2012 | Case et al. | 224/259 |
| 2012/0217275 | A1* | 8/2012 | Yu | 224/267 |
| 2014/0054337 | A1* | 2/2014 | Nakatani | A45F 5/00 224/267 |

* cited by examiner

STRAP AND ELECTRONIC DEVICE

BACKGROUND

1. Technical Field

The present disclosure relates to a strap which can be connected to an electronic device, and an electronic device.

2. Related Art

Straps can be connected to electronic devices, which help users to hold the electronic devices. For example, WO2009/101800 discloses a hand strap for a notebook-type computer. In WO2009/101800, the hand strap is configured to be attached to a bottom surface of a main body of the notebook-type computer, allowing a user to put a palm of a user's hand into the hand strap and support the bottom surface of the main body of the notebook-type computer.

SUMMARY

Electronic devices such as notebook-type computers have a relatively heavy weight, so that it is a burden for users to hold such notebook-type computers.

The present disclosure provides a strap adapted to handle a burden on a user when an electronic device is held by the user, and an electronic device including such strap.

A strap according to the present disclosure is connected to an electronic device and is used when the electronic device is held by a user with a user's hand. The strap includes:

a loop portion formed of a band member in a loop-like shape;

a connecting portion joined to the loop portion and capable of being connected to the electronic device; and a protecting member formed to cover a joining portion and a portion of a predetermined region in a bifurcation portion in the band member forming the loop portion, the joining portion being a portion where the connecting portion is connected to the band member, and the bifurcation portion bifurcating and extending out from the joining portion, thereby protecting the user's hand.

An electronic device according to the present disclosure is connected to the strap according to the present disclosure.

According the strap and the electronic device according to the present disclosure, the protecting member is formed to cover a joining portion and a portion of a predetermined region in a bifurcation portion in the band member forming the loop portion, the joining portion being a portion where the connecting portion is connected to the band member, and the bifurcation portion bifurcating and extending out from the joining portion, thereby protecting the user's hand. Accordingly, since the user's hand and fingers can be contacted with the protecting member while the user is holding the electronic device, the user's hand and fingers can be protected by the protecting member even if a burden on the user is large due to heavy weight of the electronic device.

DETAILED DESCRIPTION OF PREFERRED EMBODIMENTS

Embodiment 1

Embodiments are described in detail below, with reference to the drawings as necessary. However, unnecessarily detailed descriptions may be omitted. For example, detailed descriptions of already well-known matters or repeated descriptions of substantially the same configurations may be omitted. This is to avoid the following descriptions from becoming redundant unnecessarily, and to facilitate the understanding by a person skilled in the art. The present inventor(s) provide the accompanying drawings and the following descriptions to help a person skilled in the art to fully understand the present disclosure, and do not intend to limit the subject matter defined in the claims thereby.

In the following descriptions, terms indicating specific directions (for example, "up", "down", "left", "right", and other terms including any of them) may be used, but the use of these terms is only to facilitate understanding of the present disclosure with the reference to the drawings. Accordingly, the present disclosure should not be restrictively interpreted based on the meanings of these terms.

The Embodiments according to the present disclosure described below is applied to a portable notebook-type computer (hereinafter referred to as a "notebook-type computer", as necessary) by way of an example of an electronic device. The notebook-type computer includes a controller such as a CPU, a storage device such as a RAM, a ROM, a SSD, and the like, an input device, various external interfaces, and so on. The notebook-type computer realizes predetermined functions, by performing operational processes with a CPU in accordance with programs stored in the storage device.

1. Configuration 1-1. Configuration of Notebook-Type Computer

Figure 1:
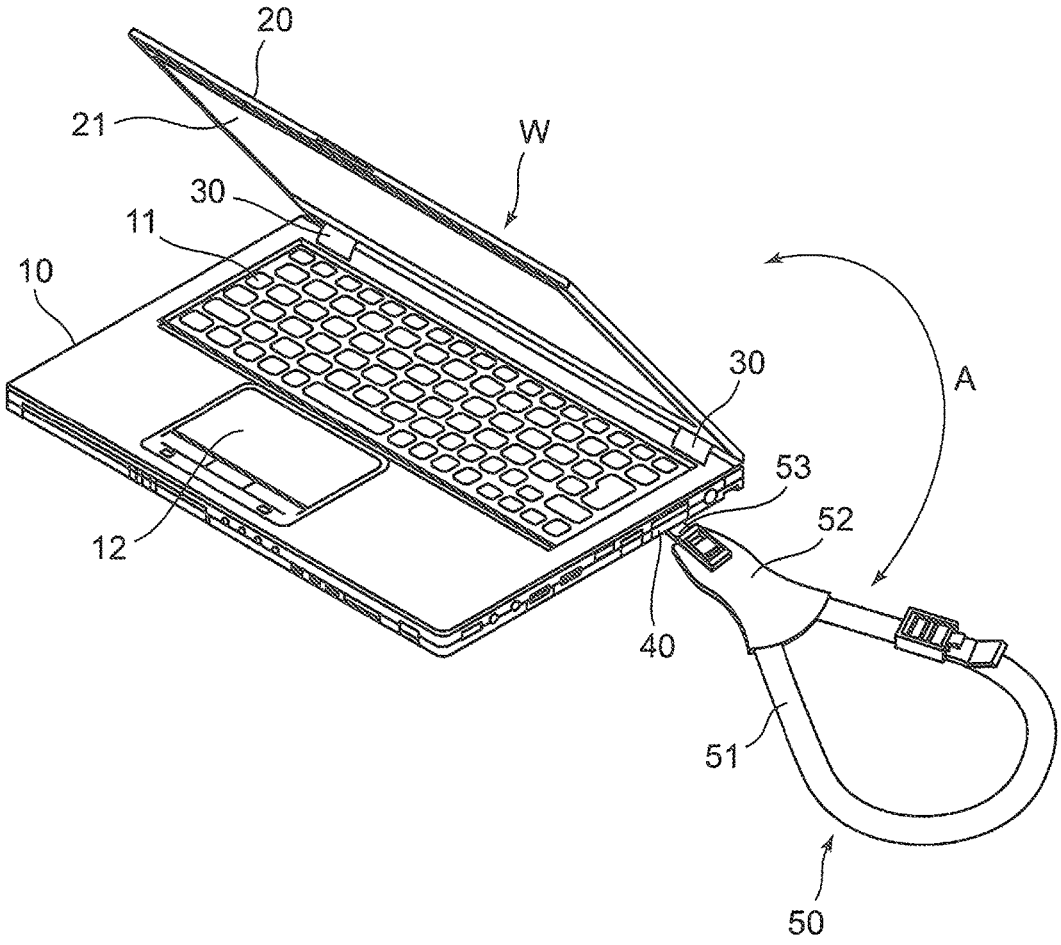
FIG. 1 is a perspective view illustrating a notebook-type computer according to the present embodiment.

FIG. 1 is a perspective view illustrating a notebook-type computer according to the present embodiment.

As shown in FIG. 1, a notebook-type computer W according to the present embodiment includes a first chassis 10 and a second chassis 20. A side portion of the first chassis 10 and a side portion of the second chassis 20 are connected to each other via a hinge 30.

The first chassis 10 has a keyboard 11 and a touchpad 12 on one main surface of thereof. In addition, the first chassis 10 includes various external interfaces, a strap attaching portion 40, and the like on a side portion of the first chassis 10. Further, the first chassis 10 includes a controller such as a CPU, a storage device such as RAM, ROM, SSD, and the like. installed therein.

The second chassis 20 has a display 21 on other main surface of thereof. The display 21 is, for example, a liquid-crystal display. The display 21 may be a display which has a touch-panel capable of detecting a touch on a display surface by a user's finger, and the like.

The first chassis 10 and the second chassis 20 are rotatable relative to each other around the hinge 30 by 360 degrees. Specifically, the first chassis 10 and the second chassis 20 are rotatable relative to each other to change their positions between a first state and a second state, the first state is a state that the first main surface of the first chassis 10 on which the keyboard 11, and the like. are provided and the first main surface of the second chassis 20 on which the display 21 is provided are facing to each other, and the second state is a state that a second main surface of the first chassis 10 on which the keyboard 11, and the like. are not provided and a second main surface of the second chassis 20 on which the display 21 is not provided are facing to each other. The notebook-type computer W can be used as a notebook-type computer when the first chassis 10 and the second chassis 20 are rotated each other around the hinge 30 so that an angle made by the first main surface of the first chassis and the second main surface of the second chassis is a predetermined angle (for example, 120 degrees). In addition, the notebook-type computer W can be used as a tablet-type computer when the notebook-type computer W is in the second state.

In the notebook-type computer W of this embodiment an orientation of an image displayed on the display 21 can be set to the portrait orientation or the landscape orientation. For this purpose, the notebook-type computer W may include an acceleration sensor and the like, for detecting an orientation of the notebook-type computer W being used, and the notebook-type computer W may automatically set the orientation of images displayed on the display 21 to either one of the portrait orientation and the landscape orientation based on the detected.

2. Configuration of Strap

In the present embodiment, a strap 50 can be attached to the notebook-type computer W, the strap 50 being used when a user holds the notebook-type computer W with a user's hand.

Figure 2:
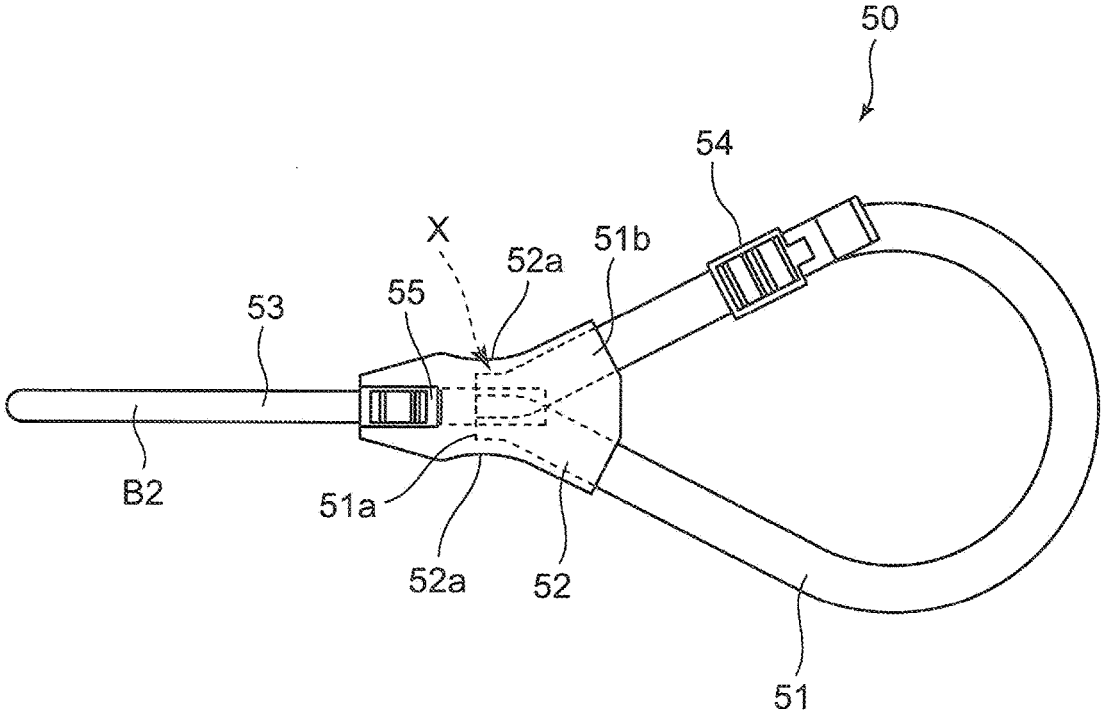
FIG. 2 is an external view of a strap according to the present embodiment.

FIG. 2 is an external view of the strap according to the present embodiment.

The strap 50 has a loop portion 51 formed of a band member in a loop-like shape, and a connecting portion 53 joined to the loop portion 51 and connected to the notebook-type computer W.

The loop portion 51 is formed in a loop-like shape by joining both end portions of a band member B1 (hereinafter referred to a "first band member B1") together. For example, a sewing process can be adopted to join the both end portions of the first band member B1 together. The loop portion 51 includes a length adjusting member 54 attached thereto for adjusting the size (arc length) of the loop. The first band member B1 is, for example, made of fabric material in a belt-like shape with a width of about 1 cm. The first band member B1 may be made of resin material for example.

The connecting portion 53 is formed by a belt-like shaped band member B2 (hereinafter referred to a "second band member B2"). A fixing member 55 is provided on the second band member B2 at an intermediate position in the longitudinal direction of the second band member B2. One end portion of the second band member B2 is joined to a joined portion 51*a* of the loop portion 51. The joined portion 51*a* is a portion where the both end portions of the first band member B1 are joined to each other. For example, a sewing process can be adopted to join the joined portion 51*a* of the first band member B1 to the second band member B2. The other end portion of the second band member B2 can be inserted to the fixing member 55, allowing the fixing member 55 to fix the other end portion of the second band member B2 to the intermediate position of the second band member B2 to form the second band member B2 in a loop-like shape. The above-mentioned other end portion of the second band member B2 can be inserted into the strap attaching portion 40 of the notebook-type computer W and then inserted in the fixing member 55. In this way, the strap 50 can be attached to the notebook-type computer W. The second band member B2 is, for example, made of fabric material in a belt-like shape with a width of about 1 cm. The second band member B2 may be made of resin material.

The strap 50 of the present embodiment includes a protecting member 52 for protecting a user's hand. The protecting member 52 is formed to cover a joining portion X and a portion of a predetermined region in a bifurcation portion 51*b* in the first band member B1 forming the loop portion 51. The joining portion X is a portion where the connecting portion 53 is connected to the first band member B1, and the bifurcation portion 51*b* bifurcating and extending out from the joining portion X. Here, the predetermined region is a region set to include an area contacted with an interdigital portion between a thumb and a first finger of the hand when the strap 50 is used as described below, of the bifurcation portion 51*b* in the first band member B1. The FIG. 2 shows only one surface side of the strap 50, but the protecting member 52 also covers the same region in the other surface side of the strap 50 (not shown). For example, a sewing process can be adopted to join the protecting member 52 to the first band member B1 and the second band member B2. The first band member B1, the second band member B2, and the protecting member 52 may be concurrently sewed together, after positioning them to form a shape of the strap 50 as an end-product. The protecting member 52 may be made of material which does not cause any uncomfortable feeling to users when the protecting member 52 contacts with the user's hand. For example, the protecting member 52 may be made of leather, artificial leather, and so on.

Figure 3:
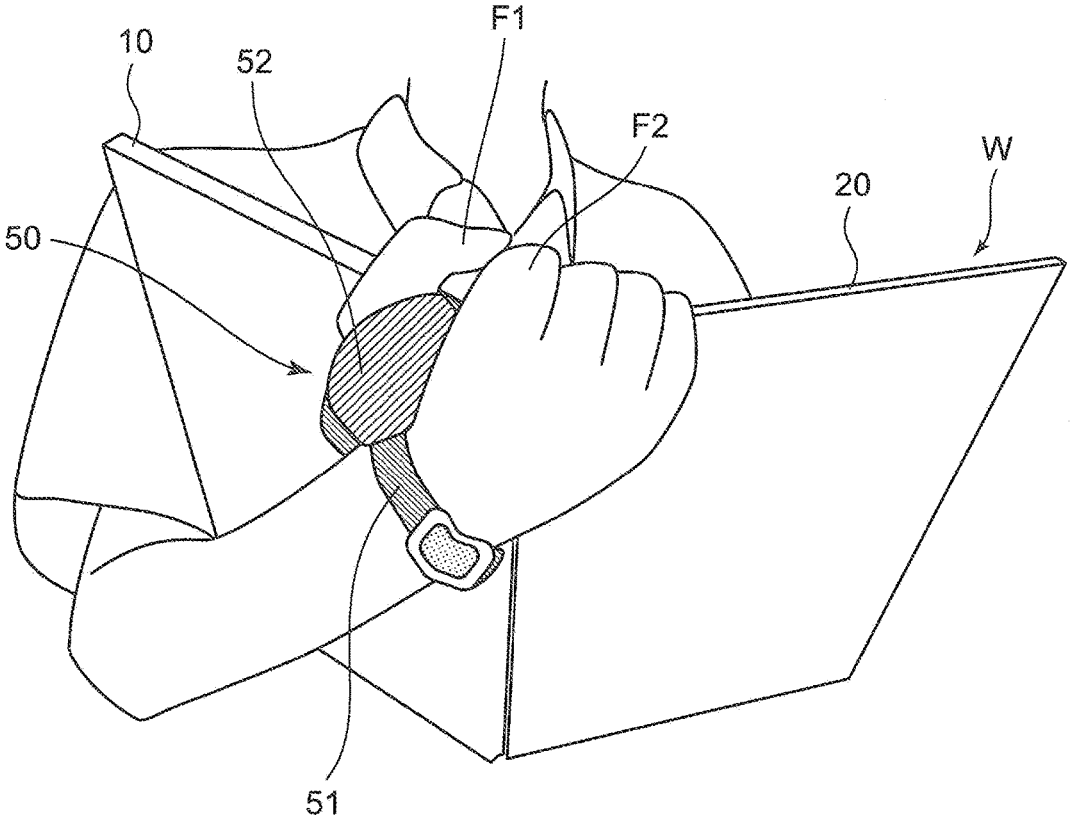
FIG. 3 is a drawing illustrating a state that the notebook-type computer is held by a user with the strap according to the present embodiment.

FIG. 3 is a drawing illustrating an exemplary state of the notebook-type computer W being held by a user with the strap 50 according to the present embodiment. This example shows a case that the user is holding the notebook-type computer W being in a state that the first chassis 10 and the second chassis 20 are opened to left and right at a predetermined angle (for example, 120 degrees) relative to each other. At this time, the notebook-type computer W is oriented so that a side portion of the first chassis 10 on which the strap attaching portion 40 is provided is located on an upper location, and the user disposes the notebook-type computer W oriented in this direction on the user's hand. In this state, the user inserts a user's wrist into the loop portion 51, and sandwiches the protecting member 52 covering a portion in the loop portion 51 with an interdigital portion between the thumb F1 and the index finger F2. Then, the user disposes the first chassis 10 on a forearm of the user, and grips side portions located on upper sides of the first chassis 10 and the second chassis 20 with a user's hand. At this time, the interdigital portion of the user's hand receives a part of the weight of the notebook-type computer W from the loop portion 51. However, in this embodiment, since the protecting member 52 is provided on the loop portion 51, the interdigital portion of the user's hand will be protected by the protecting member 52.

The protecting member 52 has a constricted portion 52*a* as shown in FIG. 2. This constricted portion 52*a* is formed in a constricted shape which corresponds to a shape of the interdigital portion between the root of the thumb and the root of the first finger when the palm of the user's hand expands to a predetermined state to hold the notebook-type computer W as shown in FIG. 3. Accordingly, when the notebook-type computer is held by the user in the manner as described above, the protecting member 52 can suitably contact with the interdigital portion between the root of the thumb and the root of the first finger.

2. Conclusion

According to the present embodiment, a strap 50 is connected to a notebook-type computer W and is used when the notebook-type computer W is held by a user with a user's hand. The strap 50 comprises:

a loop portion 51 formed of a first band member B1 in a loop-like shape;

a connecting portion 53 joined to the loop portion 51 and capable of being connected to the notebook-type computer W; and a protecting member 52 formed to cover a joining portion X and a portion of a predetermined portion in a bifurcation portion 51*b* in the first band member B1 forming the loop portion 51, the joining portion X being a portion where the connecting portion 53 is connected to the first band member B1, and the bifurcation portion 51*b* bifurcating and extending out from the joining portion X, thereby protecting the user's hand.

Therefore, the protecting member 52 is formed to cover the joining portion X and a portion of a predetermined region in a bifurcation portion 51*b* in the first band member B1 forming the loop portion 51, the joining portion X being a portion where the connecting portion 53 is connected to the first band member B1, and the bifurcation portion 51*b* bifurcating and extending out from the joining portion X, thereby protecting the user's hand. Accordingly, when the user holds the notebook-type computer W, the user's hand and fingers can be contacted with the protecting member 52. Therefore, the user's hand and fingers can be protected by the protecting member 52, even if a burden on the user is large due to heavy weight of the notebook-type computer W.

In this embodiment, the protecting member 52 protects the interdigital portion of the hand, in a state that a user's wrist is inserted into the loop portion 51 and a neighboring portion of the joining portion X joining the connecting portion 53 to the loop portion 51 is sandwiched by an interdigital portion of the hand, when the notebook-type computer W is disposed on a user's forearm and when a side portion of the notebook-type computer W is gripped by the user's hand.

Accordingly, when the notebook-type computer W is held by the user in the manner as described above, the interdigital portion of the hand can be protected by the protecting member 52.

In this embodiment, the protecting member 52 includes the constricted portion 52*a* formed in a constricted shape which corresponds to a shape of the interdigital portion between the root of the thumb and the root of the first finger, so that the interdigital portion between the root of the thumb and the root of the first finger can be protected by the protecting member 52 when the palm of the user's hand is expanded to a predetermined state.

Accordingly, the protecting member 52 can suitably contact with the interdigital portion between the root of the thumb and the root of the first finger, thereby successfully protecting the interdigital portion of the hand.

According to the present embodiment, the above-mentioned various technical effects can be achieved by a notebook-type computer W, the notebook-type computer W including:

a first chassis 10 having a keyboard 11;

a second chassis 20 having a display portion; and a hinge 30 for connecting a side portion of the first chassis 10 and a side portion of the second chassis 20 to each other.

In this embodiment, in the notebook-type computer W, the first chassis 10 and the second chassis 20 are rotatable relative to each other around the hinge 30 by about 360 degrees. The notebook-type computer W, in which the first chassis 10 and the second chassis 20 are rotatable relative to each other around the hinge 30 by about 360 degrees, requires higher strength of the hinge 30 compared with those of notebook-type computers with limited rotation angles, and therefore, the notebook-type computer W tends to increase the weight thereof. Especially in the case of such heavy notebook-type computers, the use of the strap 50 of the present embodiment provides a successful protection of the hand and fingers when the user holds such notebook-type computers.

Other Embodiments

As mentioned above, Embodiment 1 is described as an example of art disclosed in the present application. However, the art in the present disclosure is not limited thereto, but is also applicable to various embodiments to which changes, replacements, additions, omissions, etc. may be appropriately applied.

In this embodiment, the protecting member 52 is configured to cover the joining portion X joining the connecting portion 52 to the loop portion 51 and the neighboring portion thereof from both sides of the strap 50. However, the present disclosure is not limited thereto. For example, the protecting member 52 may be configured to cover the joining portion X and the neighboring portion thereof from one side of the strap 50. In this case, the user can use the strap 50 by putting the interdigital portion between fingers on a side on which the protecting member 52 is provided.

The present embodiment is described for a case where an electronic device is a notebook-type computer. However, the present disclosure is not limited thereto. The present disclosure can be widely applied to various electronic devices such as tablet-type computers, electronic notebooks, electronic game devices, and so on.

As mentioned above, the embodiments are described as an exemplification of the art disclosed in the present application. For this purpose, accompanying drawings and the detailed description are provided. Accordingly, among the components described in the accompanying drawings and the detailed description, components which are unnecessary to solve the problem may be described to exemplify the art as described above, as well as components which are necessary to solve the problem. Therefore, it should not immediately be construed that the unnecessary components are necessary as such unnecessary components are described in the accompanying drawings or the detailed description. In addition, the embodiments as described above are to exemplify the art in the present disclosure, and therefore, the embodiments can be applied various kinds of changes, replacements, additions, omissions, etc. within the scope of the claims or their equivalents

INDUSTRIAL APPLICABILITY

The present disclosure can be widely applied to various portable electronic devices such as notebook-type computers, tablet-type computers, electronic notebooks, electronic game devices, and so on.

What is claimed is:

1. An electronic device and a strap connected to the electronic device and configured to be used in a state in which the electronic device is held by a user with a user's hand, the electronic device comprising: a first chassis having a keyboard portion; a second chassis having a display portion; and a hinge for connecting a side portion of the first chassis and a side portion of the second chassis to each other; and the strap comprising: a loop portion formed of a band member having a bifurcation portion; a connecting portion joined directly to the loop portion and being capable of being connected to the electronic device; a joining portion where the connecting portion is connected to the band member; and a protecting member formed to completely cover the joining portion, the bifurcation portion and both ends of the loop portion so as to protect the user's hand, wherein the protecting member is configured to protect an interdigital portion of the user's hand, in a state in which a user's wrist is inserted into the loop portion and a neighboring portion of the joining portion is sandwiched by the interdigital portion of the user's hand, when the electronic device is disposed on a user's forearm and when the side portion of the first chassis or the side portion of the second chassis is gripped by the user's hand, and wherein the protecting member is formed in a constricted shape which corresponds to a shape of the interdigital portion between a root of a thumb and a root of a first finger of the user's hand, so that the interdigital portion between the root of the thumb and the root of the first finger of the user's hand can be protected when a palm of the user's hand is expanded to a predetermined state.

2. The strap according to claim 1, wherein an end portion of the connecting portion is directly joined to a portion of the loop portion where both end portions of the band member are joined to each other.

3. An electronic device and a strap connected to the electronic device and configured to be used in a state in which the electronic device is held by a user with a user's hand, the electronic device comprising: a first chassis having a keyboard portion; a second chassis having a display portion; and a hinge for connecting a side portion of the first chassis and a side portion of the second chassis to each other; and the strap comprising: a loop portion formed of a band member having a bifurcation portion; a connecting portion joined to the loop portion and being capable of being connected to the electronic device; a joining portion where the connecting portion is connected to the band member; and a protecting member formed to completely cover the joining portion, the bifurcation portion and both ends of the loop portion so as to protect the user's hand, wherein the protecting member is sewn to the loop portion and the connecting portion, wherein the protecting member is configured to protect an interdigital portion of the user's hand, in a state in which a user's wrist is inserted into the loop portion and a neighboring portion of the joining portion is sandwiched by the interdigital portion of the user's hand, when the electronic device is disposed on a user's forearm and when the side portion of the first chassis or the side portion of the second chassis is gripped by the user's hand, and wherein the protecting member is formed in a constricted shape which corresponds to a shape of the interdigital portion between a root of a thumb and a root of a first finger of the user's hand, so that the interdigital portion between the root of the thumb and the root of the first finger of the user's hand can be protected when a palm of the user's hand is expanded to a predetermined state.

4. The electronic device according to claim 3, wherein the first chassis and the second chassis are rotatable relative to each other around the hinge by about 360 degrees.

5. The electronic device according to claim 3, wherein the band member is made of a resin material.

6. The electronic device according to claim 3, wherein the band member is made of a fabric material.

7. The electronic device according to claim 3, wherein the protecting member has a constricted portion.

8. The electronic device according to claim 7, wherein both ends of the loop portion are joined underneath the constricted portion of the protecting member.

9. An electronic device and a strap connected to the electronic device and configured to be used in a state in which the electronic device is held by a user with a user's hand, the electronic device comprising: a first chassis having a keyboard portion; a second chassis having a display portion; and a hinge for connecting a side portion of the first chassis and a side portion of the second chassis to each other; and the strap comprising: a loop portion formed of a band member having a bifurcation portion; a connecting portion joined to the loop portion and being capable of being connected to the electronic device; a joining portion where the connecting portion is connected to the band member; and a protecting member formed to completely cover the joining portion, the bifurcation portion and both ends of the loop portion so as to protect the user's hand, wherein the protecting member is unremovably joined to the loop portion and the connecting portion, wherein the protecting member is configured to protect an interdigital portion of the user's hand, in a state in which a user's wrist is inserted into the loop portion and a neighboring portion of the joining portion is sandwiched by the interdigital portion of the user's hand, when the electronic device is disposed on a user's forearm and when the side portion of the first chassis or the side portion of the second chassis is gripped by the user's hand, and wherein the protecting member is formed in a constricted shape which corresponds to a shape of the interdigital portion between a root of a thumb and a root of a first finger of the user's hand, so that the interdigital portion between the root of the thumb and the root of the first finger of the user's hand can be protected when a palm of the user's hand is expanded to a predetermined state.

* * * * *